US005743564A

United States Patent [19]

Aarnio et al.

[11] Patent Number: 5,743,564

[45] Date of Patent: Apr. 28, 1998

[54] SHOCK-ABSORBING DEVICE FOR A SKATE

[76] Inventors: Olavi Aarnio, Lugna gatan 15, S-128 38; Erik Östnaes, Rottnevägen 8, S-128 48, both of Enskede, Sweden

[21] Appl. No.: 562,362

[22] Filed: Nov. 22, 1995

[51] Int. Cl.[6] ..... A63C 3/12

[52] U.S. Cl. ..... 280/811; 280/825; 280/11.12

[58] Field of Search ..... 280/11.12, 11.14, 280/11.17, 11.18, 11.22, 600, 807, 811, 816, 825

[56] References Cited

U.S. PATENT DOCUMENTS

| | | | |
|---|---|---|---|
| 475,926 | 5/1892 | Bryant | 280/11.12 |
| 2,764,417 | 9/1956 | Sweet | 280/11.12 |
| 3,026,119 | 3/1962 | Bauer | 280/11.18 |
| 3,497,211 | 2/1970 | Nagin | 280/825 |
| 3,545,778 | 12/1970 | Weidenbacker | 280/11.12 |
| 4,088,335 | 5/1978 | Norton et al. | 280/11.18 |
| 4,273,345 | 6/1981 | Ben-Dor et al. | 280/11.22 |
| 4,453,727 | 6/1984 | Borque | 280/811 |
| 5,234,230 | 8/1993 | Crane et al. | 280/811 |
| 5,560,625 | 10/1996 | Kuykendall | 280/11.22 |

FOREIGN PATENT DOCUMENTS

| | | | |
|---|---|---|---|
| 659159 | 4/1979 | U.S.S.R. | 280/11.12 |

*Primary Examiner*—Brian L. Johnson
*Assistant Examiner*—Frank Vanaman
*Attorney, Agent, or Firm*—Ostrolenk, Faber, Gerb & Soffen, LLP

[57] ABSTRACT

A shock-absorbing device for a skate, preferably an ice-hockey skate, comprising a surface covering (17) of elastically compressible material applied or appliable on at least a lower part (18) of the blade support (11) situated close to the blade (13) of the skate (10). The surface covering is arranged, when hit by a puck (19), to absorb a considerable proportion of the puck's kinetic energy through elastic compression of the material.

20 Claims, 1 Drawing Sheet

SHOCK-ABSORBING DEVICE FOR A SKATE

BACKGROUND OF THE INVENTION

The present invention relates to a shock-absorbing device for a skate, preferably an ice-hockey skate.

A problem well known amongst ice-hockey players for many years is that if a puck encounters a player's skate it bounces off at such high speed and at an uncontrolled angle so that the player frequently does not have time to hook it with his hockey stick while it is still within reach, or that passing the puck to another player is unsuccessful because existing blade supports do not permit controlled angling of the puck. Although this problem has been generally known for a very long time, no practically acceptable solution has previously been found.

SUMMARY OF THE INVENTION

The object of the present invention is thus to provide an advantageous solution to this problem. For this purpose, therefore, the invention relates to a shock-absorbing device for an ice-hockey skate, which device is primarily characterized in that it comprises a surface covering of elastically compressible material applied or appliable on at least a lower part of the blade support situated close to the blade of the skate, said material being arranged, when hit by a puck, to absorb a considerable proportion of the puck's kinetic energy through elastic compression of the material.

Through the desired shock-absorbing function on the skate support gained by means of a surface covering applied or appliable thereon, it is possible to prevent this function from having to encroach on the basic function of the blade support, namely that of serving as a stable support for the blade of the skate. The main part of the blade support situated beneath the elastically compressible surface covering can thus be manufactured in conventional manner from a material with sufficient rigidity for the intended function. The embodiment proposed according to the invention also allows the rebound angle of the puck to be controlled. According to a preferred embodiment of the invention said surface covering may advantageously consist of a prefabricated element of elastically compressible material. This element may be applied on the blade support in conjunction with manufacture of the skate. However, it may alternatively comprise a separate accessory that can be applied subsequently on the blade support of an existing skate. In both cases the element may preferably be secured to the blade support with the aid of a binder suitable for the purpose. This binder may preferably consist of a self-adhesive coating applied on said element.

The above-mentioned prefabricated element may have the general shape of a ribbon of elastically compressible material which is preferably in the form of a continuous, flexible ribbon of said material. To facilitate correct placing of the ribbon on the blade support and enable it to be secured better, the blade support may be provided grooves running along each side thereof in order to receive an inner portion of said ribbon.

The elastically compressible surface coating may also consist of a surface covering of elastically compressible material applied permanently on the blade support in conjunction with manufacture of the skate. This coating may be produced, for instance, by spraying or brushing on one or more layers of said material on a selected portion of the blade support.

Alternatively, said surface covering may be produced by being moulded onto the blade support.

The precise character of the elastically compressible material, and even the choice of material therein, may be varied in many ways within the scope of the invention. Said surface covering may consist, for instance, at least substantially of plastic or rubber material with cell structure and suitable elastomeric properties. Furthermore, on its outer side facing away from the blade support, it may be almost smooth or it may be provided with resiliently flexible studs, flanges or other projections protruding from most of its surface.

BRIEF DESCRIPTION OF THE DRAWINGS

The invention will be described in more detail with reference to the accompanying drawings in which.

DESCRIPTION OF THE PREFERRED EMBODIMENTS

Figure 1:
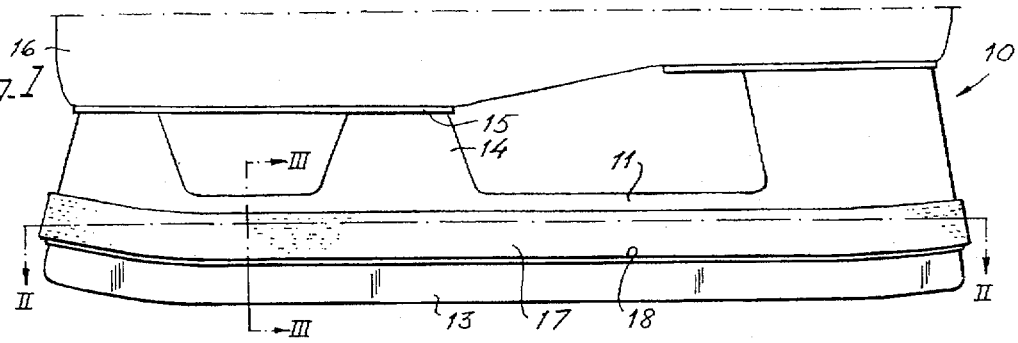
FIG. 1 shows a side view of a lower part of an ice-hockey skate provided with a shock-absorbing device according to an embodiment of the invention selected by way of example.

In FIG. 1 an ice-hockey skate is generally designated 10 and consists in conventional manner of an elongate blade support 11 manufactured from a plastic material having high rigidity and hardness, a steel blade 13 secured in a longitudinal groove 12 (FIG. 3) in the lower side of the blade support, and a boot 16 carried by uprights 14 and support plates 15 of the blade support 11 connected thereto.

Figure 2:
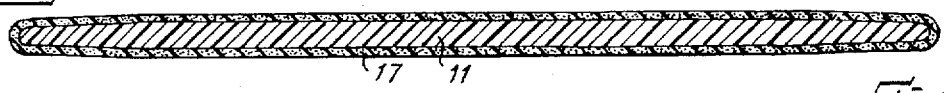
FIG. 2 shows a horizontal projection in section along the line II—II in FIG. 1.

With the object of achieving a shock-absorbing device able to reduce the rebound velocity of a puck that encounters the blade support 11, said support is provided along a lower, longitudinal portion thereof with an elastically compressible surface covering formed by a separately manufactured, ribbon-shaped element 17 of elastically compressible material, an inner portion of which is received in grooves 18 running longitudinally along each side of the blade support 11. This element may be manufactured in the form of a continuous ribbon, as shown in FIG. 2, which is preferably secured to the blade support 11 with the aid of a suitable binder, preferably formed by a self-adhesive coating applied on the element 17. To enable the element 17 in the form of a continuous ribbon to be applied in close contact with the blade support 11, said element should consist of a flexible material.

The element 17 may consist of an optional, suitably elastic, compressible, plastic or rubber material, such as such material with cell structure. Furthermore, it should be applied in such a position on the blade support 11 that it covers at least the part of the blade support 11 situated a short distance above the free part of the blade 13 where a puck 19 gliding along the ice would encounter the blade support, as shown in FIG. 3.

Figure 3:
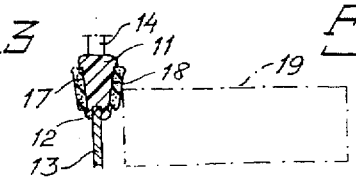
FIG. 3 shows a partial view in section along the line III—III in FIG. 1.
Figure 4:
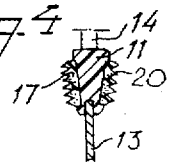
FIG. 4 is a fragmentary cross-sectional view showing a first alternate embodiment of the device.

FIG. 3 shows the element 17 as having substantially smooth surfaces. FIG. 4, however, shows an alternative embodiment of the element 17 in which the outer side is provided with projections in the form of longitudinal, flexible flanges 20.

Figure 5:
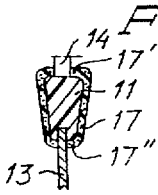
FIG. 5 is a fragmentary cross-sectional view of a second alternate embodiment of the device.

Another alternative embodiment of the element 17 is shown in FIG. 5 where, instead of being partially inset in a groove in the blade support 11, the element 17 is shaped with upper and lower edge flanges 17' and 17", respectively, by means of which it is in contact with upper and lower edge surfaces, respectively, of the longitudinal main part of the blade support 11.

The element 17 may advantageously be applied on the skate 10 at the time of manufacture. However, it may also be supplied as a separate accessory to be applied subsequently on an existing skate.

As an alternative to a surface covering for the blade support in the form of a separate, prefabricated element of elastically compressible material, a surface covering may be used consisting of one or more layers of such material applied on the blade support by spraying or brushing. Surface covering may also be used which has been produced by moulding it onto the blade support. Finally it should also be mentioned that the elastically compressible surface covering may cover considerably larger areas of the blade support than is the case in the embodiments of the invention shown in the drawings.

The surface covering may of course also be arranged detachable by means of press-studs or the like.

We claim:

1. A shock-absorbing device for an ice skate, wherein the ice skate includes:

a blade having a bottom, the blade having a front end toward the front of the skate and a rear end toward the rear of the skate and the blade extending from the front end to the rear end of the blade;

a blade support above the bottom of the blade, the blade support being connectable to a foot of a wearer, the blade support including a lower part close to the blade, the blade support having opposite lateral sides and a groove;

the shock absorbing device comprising a surface covering of elastically compressible material adapted to be disposed in the groove and applied on the opposite lateral sides of and at least on the lower part of the blade support situated close to the blade and extending along the blade support continuously from the front end of the blade to the rear end of the blade; the covering being shaped and positioned to be hit by a puck that would hit the blade support if the covering was not present, the compressible material being able to absorb kinetic energy of the puck through elastic compression of the compressible material.

2. The device of claim 1, wherein the surface covering comprises a prefabricated element of elastically compressible material.

3. The device of claim 2, further comprising a binder adapted to secure the element to the blade support.

4. The device of claim 3, wherein the binder comprises a self adhesive coating applied on the prefabricated element between the prefabricated element and the blade support.

5. The device of claim 2, wherein the prefabricated element is a separate part separate from the blade support that is adapted to be applied to the blade support.

6. The device of claim 5, further comprising a binder adapted to secure the prefabricated element to the blade support.

7. The device of claim 5, wherein the prefabricated element is generally shaped like a ribbon of compressible material extending from the front end to the rear end of the blade.

8. The device of claim 1, wherein the covering is generally shaped like a ribbon of compressible material extending from the front end to the rear end of the blade.

9. The device of claim 8, wherein the compressible element is in the form of a continuous flexible ribbon of compressible material.

10. The device of claim 1, wherein the surface covering of elastically compressible material is adapted to be permanently applied on the blade support and is not separate therefrom.

11. The device of claim 10, wherein the surface covering is adapted to be applied by spraying to produce at least one layer of material on the blade support.

12. The device of claim 10, wherein the surface covering is adapted to be adapted by brushing to produce at least one layer of material on the blade support.

13. The device of claim 10, wherein the surface covering is adapted to be applied by molding to produce at least one layer of material on the blade support.

14. The device of claim 1, wherein the compressible material of the surface covering is at least substantially a material with a cell structure.

15. The device of claim 14, wherein the compressible material of the surface covering is plastic.

16. The device of claim 14, wherein the compressible material of the surface covering is rubber.

17. A shock-absorbing device for an ice skate, wherein the ice skate includes:

a blade having a bottom, the blade having a front end toward the front of the skate and a rear end toward the rear of the skate and the blade extending from the front end to the rear end of the blade;

a blade support above the bottom of the blade, the blade support being connectable to a foot of a wearer, the blade support including a lower part close to the blade, the blade support having opposite lateral sides;

the shock absorbing device comprising a surface covering of elastically compressible material adapted to be applied on the opposite lateral sides of and at least on the lower part of the blade support situated close to the blade and extending along the blade support continuously from the front end of the blade to the rear end of the blade; the covering having an outer surface, being shaped and positioned to be hit by a puck that would hit the blade support if the covering was not present, the compressible material being able to absorb kinetic energy of the puck through elastic compression of the compressible material, and having resiliently flexible studs, flanges or other projections protruding from most of the outer surface.

18. The device of claim 17, wherein the surface covering comprises a prefabricated element of elastically compressible material.

19. The device of claim 17, wherein the surface covering is shaped generally like a ribbon extending along the blade support.

20. The device of claim 17, wherein the surface covering is adapted to be detachable.

* * * * *